US006342778B1

(12) United States Patent
Catalano et al.

(10) Patent No.: US 6,342,778 B1
(45) Date of Patent: Jan. 29, 2002

(54) LOW PROFILE, SURFACE MOUNT MAGNETIC DEVICES

(76) Inventors: Robert James Catalano, 2504 Waterloo La., Mesquite, TX (US) 75181; Paul Joseph Offer, Jr., 6516 Briarhaven Dr., Dallas, TX (US) 75240; Matthew Anthony Wilkowski, 2339 Heatherdale Dr., Mesquite, TX (US) 75150

( * ) Notice: Subject to any disclaimer, the term of this patent is extended or adjusted under 35 U.S.C. 154(b) by 0 days.

(21) Appl. No.: 09/552,811

(22) Filed: Apr. 20, 2000

(51) Int. Cl.[7] ..... G05F 1/613; H01F 5/00
(52) U.S. Cl. ..... 323/224; 336/200
(58) Field of Search ..... 323/224, 220; 336/200

(56) References Cited

U.S. PATENT DOCUMENTS 5,574,420 A 11/1996 Roy ..... 336/200
6,094,123 A * 7/2000 Roy ..... 336/200
6,118,351 A * 9/2000 Kossives et al. ..... 333/24.1

* cited by examiner

*Primary Examiner*—Adolf Deneke Berhane

(57) ABSTRACT

A low-profile, surface mount magnetic component is described along with magnetic devices and power supplies using the magnetic components. The magnetic component is formed from a magnetic core which is surrounded by a plurality of conductive elements. The conductive elements fit into channels in the sides of the magnetic core, the channels having angled sides that increase in width from the top to the bottom. The conductive elements have their ends bent inwards against the bottom of the magnetic core to form surface mountable contact surfaces. A recess in the top of the magnetic core allows the conductive elements to be loaded before the ends are bent inward so that when the conductive elements are unloaded they fit tightly against the magnetic core and the conductive surfaces are coplanar.

5 Claims, 3 Drawing Sheets

LOW PROFILE, SURFACE MOUNT MAGNETIC DEVICES

TECHNICAL FIELD OF THE INVENTION

The invention relates to magnetic devices such as inductors and transformers. Specifically, the invention relates to magnetic devices that can be assembled as low profile surface mount devices on a printed circuit board or a metallized substrate.

BACKGROUND OF THE INVENTION

Magnetic devices, such as inductors and transformers, are employed in many different types of electrical devices including communications equipment and power supplies. In practice, most magnetic devices are fabricated of one or more windings, formed by an elongated electrical conductor, such as a wire of circular or rectangular cross-section, or a planar electrical conductor wound about or mounted to a bobbin composed of a dielectric material, such as plastic. In some instances, the electrical member is soldered to terminations on the bobbin. Alternatively, the electrical member may be threaded through the bobbin for connection directly to a metallized area of an underlying circuit board. A magnetic core may be disposed about the bobbin to impart a greater reactance to the magnetic device and thereby alter its operating characteristics. The use of a bobbin, however, generally results in a magnetic device with a large profile, which not only takes up valuable space on the circuit board, but also results in a large height for the overall electrical device.

In addition to being formed with bobbins, magnetic devices can be formed with a magnetic core, such as ferrite or iron, wound with conductive coils. These devices are sometimes referred to as wire-wound core devices. One major difficulty with wire-wound core devices is that they have been difficult to miniaturize. While components such as resistors, diodes, capacitors and transistors have been drastically reduced in size, magnetics, including bobbin and wire-wound core devices, remain bulky.

One attempt at a low profile magnetic device is described in U.S. Pat. No. 5,574,420 issued Nov. 12, 1996 to Roy et al. The device described in Roy et al. is a magnetic component formed by a plurality of conductive elements surrounding a magnetic core. The conductive elements pass through holes or channels in the magnetic core and then are bent outwards to allow surface mount connection to a printed wiring board or the equivalent. Unfortunately, the magnetic component described by Roy et al. suffers from a number of deficiencies. First, the device is incapable of carrying large amounts of current because the small area of the magnetic core that is surrounded by the conductive elements tends to saturate quickly. Second, the bent out ends of the conductive elements make poor surface mount conductors because they are very difficult to make coplanar. Finally, the magnetic components of Roy et al. can be difficult to manufacture due to the shape of the magnetic core and the arrangement of the conductive elements.

Accordingly, what is needed is a low profile magnetic component that is capable of handling larger currents, has more consistently coplanar conductor elements, and is more easily manufactured.

SUMMARY OF THE INVENTION

Embodiments of the invention include providing for a low profile magnetic component formed from a magnetic core and a plurality of conductive elements, also referred to as conductors. The magnetic core includes a bottom, a top, end surfaces and side surfaces. The side surfaces include portions that are angled inward from the bottom to the top thereby forming a plurality of channels. The magnetic core further includes a recess in the top adjacent to the channels.

The plurality of conductors surround the magnetic core and pass through a corresponding channel from the plurality of channels. The top of the conductors are adjacent to the recess in the magnetic core and the ends are bent inward against the bottom of the core. The ends of the conductors form contact surfaces which are coplanar and surface mountable. In order to form the conductors tightly around the magnetic core and to ensure that the contact surfaces formed by the ends are coplanar, during manufacture the tops of the conductors are loaded causing the ends to bend inward in to the recess in the magnetic core. While the conductors are loaded the ends are bent inward toward the center of the bottom. After bending, the conductors are unloaded and the spring tension in the conductors causes them to fit tightly around the magnetic core and causes the ends to fit snugly against the base.

The magnetic components can be formed into a magnetic device such as an inductor by placing two or more in close proximity and using conductive traces on a printed wiring board or other insulated substrate to form the conductors into windings. This magnetic device can then be utilized in a power supply as, for example, the inductor in an output filter or as transformers in groups of two or more.

The foregoing has outlined, rather broadly, preferred and alternative features of embodiments of the invention so that those skilled in the art may better understand the detailed description of the invention that follows. Additional features of the invention will be described hereinafter that form the subject of the claims of the invention. Those skilled in the art will appreciate that they can readily use the disclosed conception and specific embodiment as a basis for designing or modifying other structures for carrying out the same purposes of the invention. Those skilled in the art will also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE DRAWINGS

Figure 1:
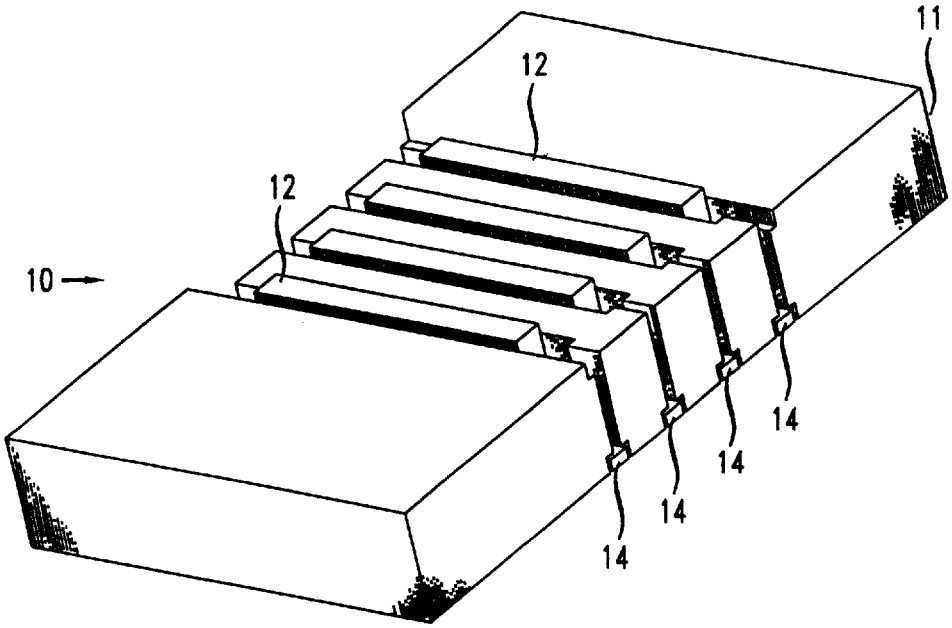
FIG. 1 (PRIOR ART)
FIG. 1 is a perspective view of a low profile magnetic component according to a conventional arrangement.

Referring now to FIG. 1, a conventional surface mount magnetic component 10 is shown. Magnetic component 10 is formed by body 11 of magnetic material that is surrounded by a plurality of conductive elements 12 distributed along the major dimension of body 11. Each conductive element 12 is formed with four right angle bends, the first and second bends allowing conductive element 12 to pass through channels 16 to surround a portion of the body, and the third and fourth bends to form a pair of contact surfaces 14. Magnetic component 10, however suffers from a variety of drawbacks. First, by having conductive elements 12 pass at right angles through channels 16, a large portion of the cross-section of body 11 is not surrounded by conductive elements 12. By limiting the cross-section of body 11 surrounded by conductive elements 12, the magnetic flux able to be carried by body 11 is limited. Next, the third and fourth bends that form contact surfaces 14 are formed by bending conductive element 12 outward in free space. By forming contact surfaces 14 in this manner making them coplanar for surface mounting within specific tolerances is very difficult. Finally, magnetic component 10 is manufactured by taking the preformed conductive elements and placing them around body 11. This type of manufacturing is difficult and only exacerbates the problem of trying to make contact surfaces 14 for all conductive elements 12 coplanar. If one conductive element 12 is misplaced by as little as a few thousands of an inch the coplanarity of the entire device is unacceptable.

In order to overcome these limitations a low-profile magnetic component is needed that a) uses as much of the cross-section of the magnetic core as possible, b) has conductive elements with contact surfaces that are tightly coplanar, and c) is easy to manufacture within design tolerances.

Figure 2A:
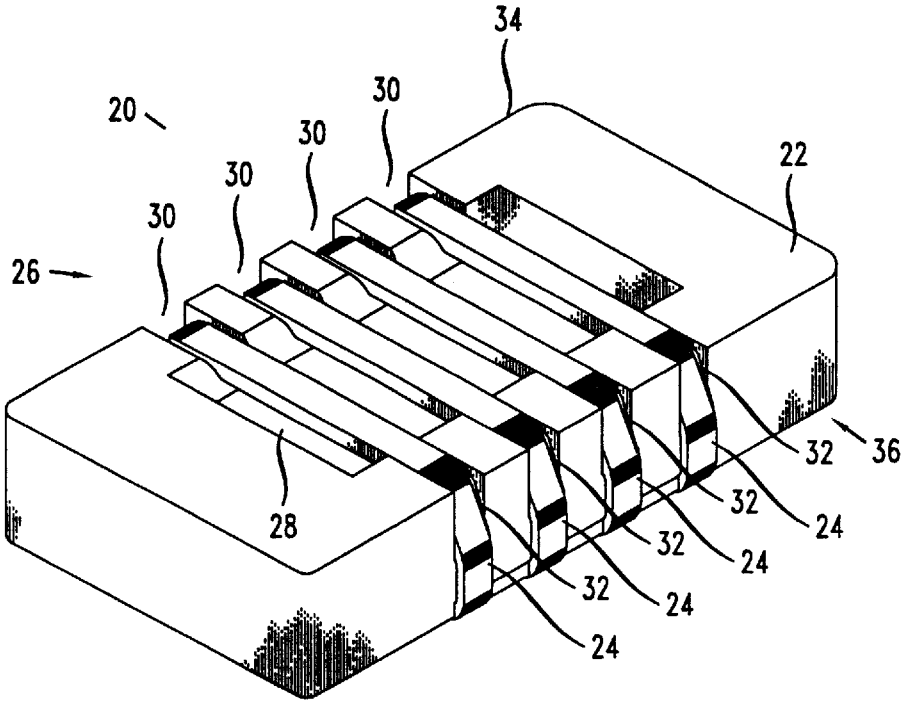
FIG. 2*a* is a perspective view of a low profile magnetic component according to an embodiment of the invention.
Figure 2B:
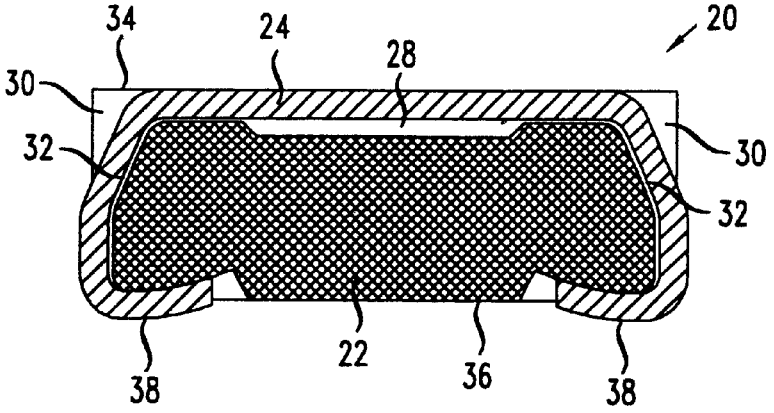
FIG. 2*b* is a cross-sectional view of the magnetic component from FIG. 2*a;*

Referring now to FIGS. 2*a* and 2*b*, a magnetic component according to an embodiment of the invention is shown. Low-profile magnetic component 20 shown in FIGS. 2*a* and 2*b* is formed from magnetic core 22 and a plurality of conductive elements 24. Magnetic core 22 typically is rectangular in shape, having a length l greater than the width w and height h. Conductive elements 24 are located in a center section 26 along the length l of magnetic core 22. Center section 26 contains a number of features to accommodate conductive elements 24, including recess 28 in the top 34 of magnetic core 22, and channels 30, which further include angled side surfaces 32. Angled side surfaces 32 form a cross section that increases from top 34 to some distance above bottom 36 of magnetic core 22. The angled side surfaces allow for better inspection capability of the assembled component. Wrapping the conductive elements 24 around the outside of magnetic core 22 allows more cross-sectional area to be surrounded by conductive elements 24. This greater crosssectional area increases the amount of flux that can be handled by the core before saturation, and therefore, increases the amount of current that the magnetic device can accommodate.

Conductive elements 24 are also formed with coplanar contact surfaces 38. Unlike magnetic device 10 from FIG. 1, contact surfaces 38 are formed by bending conductive elements 24 inward against the bottom 36 of magnetic core 22. Bending conductive elements 24 inward to form contact surfaces 38 allows for much greater control over the coplanarity of the contact surfaces. Bottom 36 of magnetic core 22 is used as a stop to ensure consistent coplanarity both between contact surfaces 38 of a specific conductive element 24 as well as between contact surfaces 38 of different conductive elements 24. Recess 28, in top 34 of magnetic core 22, aids in the formation of contact surfaces 38. During manufacture, the top of conductive element 24 is displaced into recess 28 before it is bent to form contact surfaces 38. After contact surfaces 38 are bent into place, the top of conductive element 24 is unloaded releasing the spring tension, which causes contact surfaces 38 to curl tightly up against bottom 36 of magnetic core 22. Use of this loading of conductive element 24 allows a much more consistent formation of contact surfaces 38 which result in very coplanar surface mount contacts. The loading technique also allows conductive elements 24 to fit more tightly around magnetic core 22 to limit any potential movement of the conductive elements 24.

Figure 3:
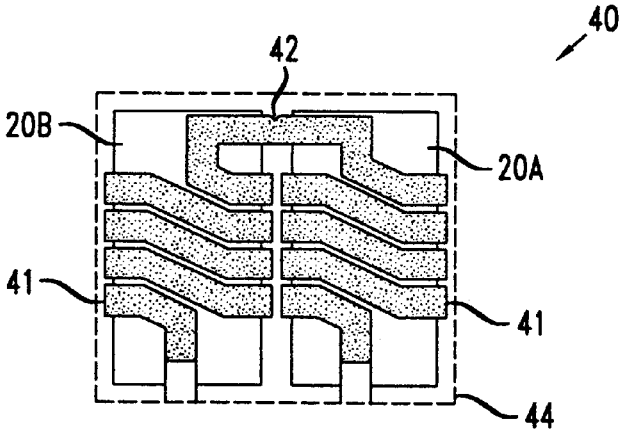
FIG. 3 is plan view of a magnetic device formed from an insulating substrate with conductive traces and two of the magnetic components from FIG. 2.

A magnetic device is formed from magnetic component 22 by mounting two or more devices in close proximity on an insulating substrate having conductive traces for interconnecting the conductive elements of the magnetic component into windings. FIG. 3 shows a magnetic device 40 formed from a pair of magnetic components 20A and 20B placed side by side to form an air gap 42 between them. Conductive trace 41 on an insulating substrate, such as printed wiring board 44, is used to interconnect the conductive elements of magnetic devices 20A and 20B into windings. The magnetic components 20A and 20B, air gap 40 and conductive trace 41 together form a magnetic device 42 such as an inductor. Although magnetic device 40 is formed using two magnetic components, those skilled in the art would understand that similar magnetic devices could be formed using any number of magnetic components.

Figure 4:
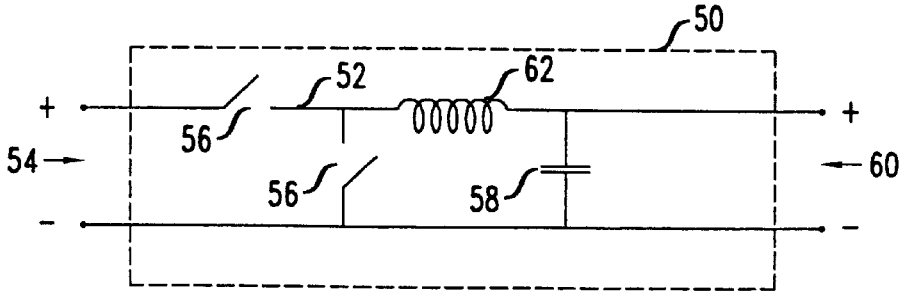
FIG. 4 is a circuit diagram showing a power supply incorporating the magnetic device from FIG. 3.

The inductor formed by magnetic device 40 from FIG. 3 is suitable as a magnetic element in a power supply module. The circuit for such a power supply module 50 is shown in FIG. 4. Power supply module 50 is formed by buck converter 52 with input voltage 54, power switches 56, output filter 58 and regulated output voltage 60. Inductor 62 in output filter 58 is formed from magnetic device 40 from FIG. 3. The operation of buck converter 50 is well understood in the art and will not be discussed further. Although the magnetic device is shown with reference to a buck-type converter, those skilled in the art would understand that the magnetic device according to embodiments of the invention is suitable for use in any type power supply which utilizes magnetic devices, particularly inductors.

Figure 5:
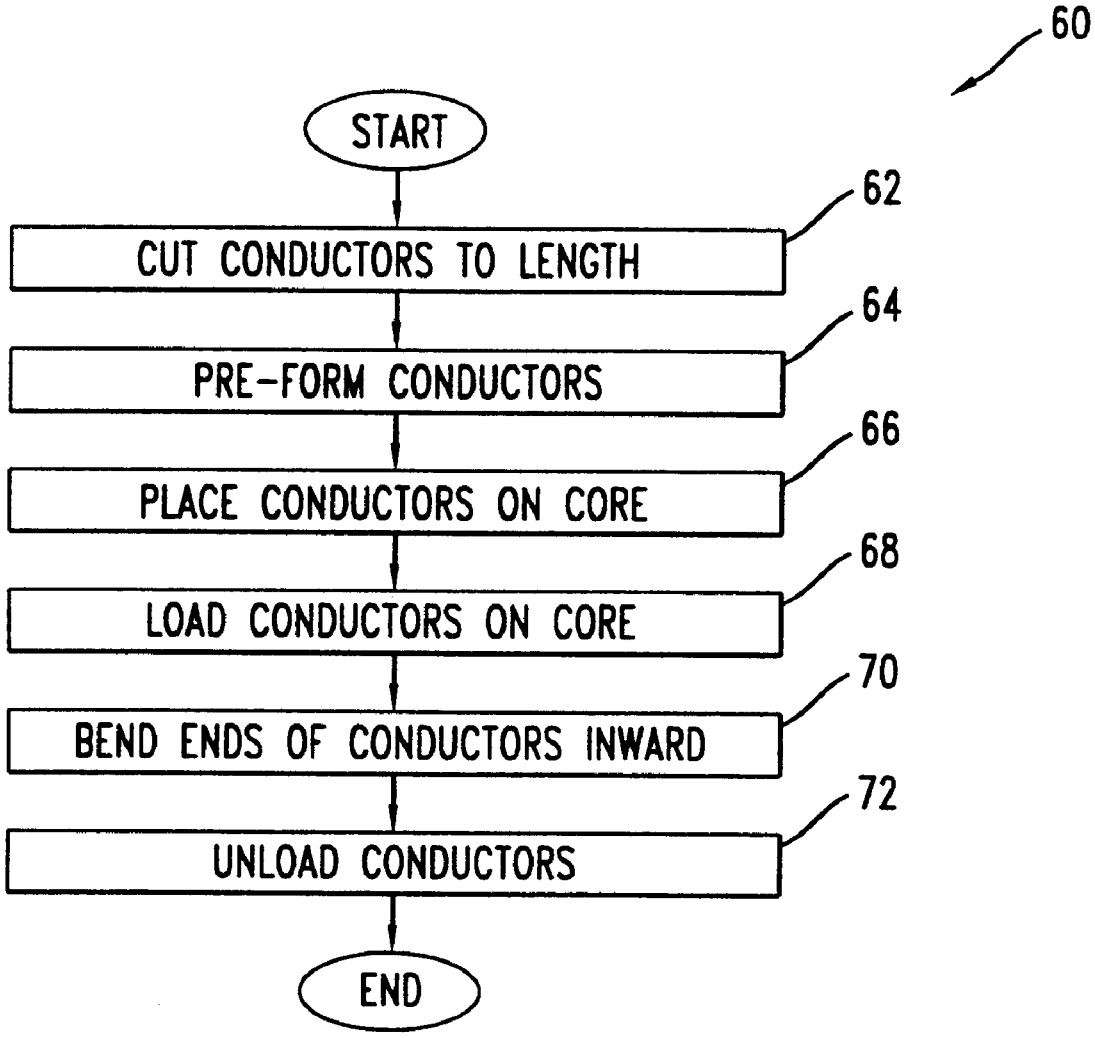
FIG. 5 is a flow chart describing a process for making a low profile magnetic device in accordance with the principles of the invention.

Referring now to FIG. 5, a flow chart is shown that generally describes the manufacturing process 60 for making a magnetic component 20 from FIGS. 2*a* and 2*b* according to embodiments of the invention. Manufacturing process 60 begins at step 62 by cutting conductive elements 24 to the required length from a continuous supply of conductive material. Once the conductors are cut to length, the process proceeds to step 64 where the conductors are preformed by bending them into a u-shape such that they will fit around the magnetic core 22. Step 66 then requires that the conductors be placed around magnetic core 22. In step 68 the tops of the conductors are loaded forcing them down slightly into recess 28 as was described with reference to FIGS. 2*a* and 2*b*. The process then proceeds to step 70 where the ends of the conductors are bent inward against the bottom 36 of magnetic core 22 to form contact surfaces 38. Finally the tops of conductors, or conductive elements 24, are unloaded allowing the conductors to fit snugly to the magnetic core 22 and allowing contact surfaces 38 to form coplanar surfaces for surface mounting.

Typically, the embodiment magnetic core 22 is a ferrite material. For example, the conductive elements 24 are formed from copper, which is coated for solderability. Although particular references have been made to specific structures, topologies and materials, those skilled in the art should understand that magnetic component 20 could be formed in a multitude of materials and in a multitude of shapes and sizes, all of which are well within the broad scope of the invention.

Although embodiments of the invention has been described in detail, those skilled in the art should understand that they can make various changes, substitutions and alterations herein without departing from the spirit and scope of the invention in its broadest form.

We claim:

1. A low profile power supply module for converting an input to a regulated output comprising:

a printed wiring board;

at least one power semiconductor device connected to the printed wiring board and operable to allow power to flow from the input to the regulated output; and an output filter electrically connected to the printed wiring board and operable to provide a stable voltage at the output, the output filter including an inductor which is formed from at least two low profile magnetic devices, each of the low profile magnetic devices further comprising:

a magnetic core having a top, a bottom, two long sides, and two short sides, wherein the two long sides include a plurality of channels formed at an angle from near the bottom to the top; and a plurality of conductors surrounding the magnetic core and electrically connected to the printed wiring board, wherein a portion of the conductors is in a corresponding channel from the plurality of channels, and wherein the ends of the plurality of conductors are bent inward adjacent to the bottom of the magnetic core.

2. The power supply module of claim 1 wherein the power supply is a board mountable dc-to-dc power supply module.

3. The power supply module of claim 1 the magnetic core includes a recess in the top.

4. The power supply module of claim 3 wherein the recess allows the conductors to be loaded during manufacture, thereby allowing the ends of the conductors to be fit tightly against the bottom of the magnetic core.

5. The power supply module of claim 1 wherein the plurality of conductors includes four conductors.

* * * * *